United States Patent [19]

Tillery et al.

[11] Patent Number: 4,793,618

[45] Date of Patent: Dec. 27, 1988

[54] SELF-SCORING ELECTRONIC TARGET GAME WITH VIDEO DISPLAY

[75] Inventors: Michael L. Tillery; Paul F. Beall, both of Rockford, Ill.

[73] Assignee: Arachnid, Inc., Rockford, Ill.

[21] Appl. No.: 88,723

[22] Filed: Aug. 24, 1987

Related U.S. Application Data

[63] Continuation-in-part of Ser. No. 926,916, Nov. 3, 1986, abandoned.

[51] Int. Cl.[4] ..... F41J 3/00; F41J 3/02

[52] U.S. Cl. ..... 273/376; 273/1 ES

[58] Field of Search ..... 273/373, 376, 1 ES, 273/1 E, 85 G, 327, 371, 372, 374, DIG. 28

[56] References Cited

U.S. PATENT DOCUMENTS

| | | | |
|---|---|---|---|
| 1,075,264 | 10/1913 | Morrison, Jr. . | |
| 3,454,276 | 7/1969 | Brenkert et al. | 273/102.2 |
| 3,455,553 | 7/1969 | Melvin | 273/102.2 |
| 3,790,173 | 2/1974 | Callaway | 273/102.2 R |
| 3,805,030 | 4/1974 | Wichinsky et al. | 235/92 GA |
| 3,972,531 | 8/1976 | Knapp | 273/102.2 R |
| 4,003,579 | 1/1977 | Miscavage | 273/148 R |
| 4,057,251 | 11/1977 | Jones et al. | 273/95 R |
| 4,516,781 | 5/1985 | DeVale et al. | 273/373 |
| 4,561,660 | 12/1985 | Zammuto | 273/376 |
| 4,567,461 | 1/1986 | Honekman et al. | 340/323 R |
| 4,586,716 | 5/1986 | Brejcha et al. | 273/376 |
| 4,635,940 | 1/1987 | Kelley | 273/347 |
| 4,651,998 | 3/1987 | Holt et al. | 273/347 |

FOREIGN PATENT DOCUMENTS 547831 4/1983 Australia .

OTHER PUBLICATIONS

British Aircraft Corp. Ltd., "Project 'ARACHNID', Report on Pre-University Course Project", Dec., 1973.

*Primary Examiner*—Maryann Lastova

[57] ABSTRACT

An electronic target game adapted for use with a display device which is disposed within the viewing region of the game. The preferred embodiment is a dart game employing "safe" darts and a dart board which is divided into a plurality of target sections and an associated pressure sensitive switch matrix. A microprocessor executes instructions stored in an EPROM memory unit which is easily removed and interchanged from the game. The EPROM memory unit contains instructions for a variety of dart games with different rules and procedures of play. The invention provides one or more displays for selecting a game and displaying scores, instructions and various game conditions.

15 Claims, 7 Drawing Sheets

SELF-SCORING ELECTRONIC TARGET GAME WITH VIDEO DISPLAY

CROSS REFERENCE TO RELATED APPLICATION

This application is a continuation-in-part of U.S. application Ser. No. 926,916, filed on Nov. 3, 1986, now abandoned.

BACKGROUND OF THE INVENTION

This invention relates generally to electronic games, and more particularly to computerized dart games which automatically register and display the score attained by players. In its principal aspects the invention is concerned with an improved computerized electronic target game which is characterized by the provision of display capabilities for displaying game conditions and information in respect to games in play.

Electronic dart games are well known from Jones et al. U.S. Pat. No. 4,057,251; Zammuto U.S. Pat. No. 4,561,660 and Brejcha et al. U.S. Pat. No. 4,586,716. These patents relate to the use of "safe" darts made with a slender flexible plastic tip which is virtually incapable of piercing human skin and unlikely to cause damage when hitting objects other than the dart board. Jones et al. introduced the "safe" darts and a dart board divided into an array of target plates with a large number of closely spaced holes for securing darts thrown at the board. The impact force of a thrown dart displaces a target plate and momentarily closes an associated switch to electrically indicate a dart hit. Zammuto improves on the game by using a solid rubber damper sheet for biasing target sections and a matrix switch of imprinted Mylar sheets to increase reliability in scoring. Brejcha et al. further enhances the game by providing a double bullseye as in the official bristol dart board of the British darts organization.

SUMMARY OF THE INVENTION

A primary object of the present invention is to provide an electronic dart game with display means for displaying various information about the dart game, including scoring and instruction information. This novel display feature allows scoring and the display of game conditions for dart games with relatively complex rules which previously have only been scored by hand.

A related object of the present invention is to use the display means to display dart game information in a manner which is amusing and entertaining to the dart game players.

Another important object of the present invention is to electronically store the rules and instructions for a variety of different dart games in a static electronic memory unit which may easily be removed and interchanged from the game, thereby providing a convenient means for changing and introducing new dart games.

In keeping with the foregoing objects, an electronic dart game for one or more players having successive turns is provided which comprises an electronic dart board forming a target of a plurality of scoring segments, first and second storage areas and a switch matrix for indicating which one of the plurality of scoring segments is hit by a thrown dart. The first memory storage area contains algorithms for executing the rules and instruction of a number of different dart games, any one of which can be selected by the players. The second storage area is provided for retaining information regarding which of the scoring elements were hit by thrown darts during at least one previous turn of the same player. Additionally, there is provided an electronic data processor responsive to the switch matrix and first and second memory storage areas for calculating the appropriate dart game conditions and providing a display of those conditions on a display means.

BRIEF DESCRIPTION OF THE DRAWINGS

Other objects and advantages of the invention will become apparent from the following detailed description and the accompanying drawings, in which.

While the invention will be described in connection with certain preferred embodiments, it will be understood that it is not intended to limit the invention to these particular embodiments. On the contrary, it is intended to cover all alternatives, modifications and equivalents as may be included within the spirit and scope of the invention as defined by the appended claims.

DETAILED DESCRIPTION OF THE INVENTION

Figure 1:
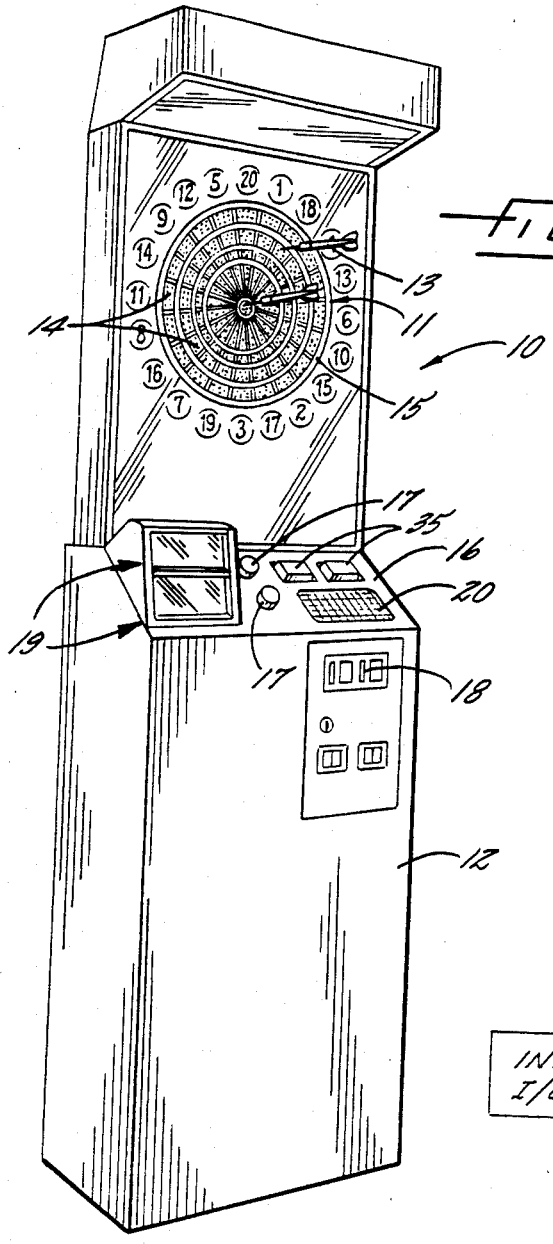
FIG. 1 is a perspective drawing of an electronic dart game incorporating the invention.

Turning now to the drawings, FIG. 1 shows an embodiment of the invention having an electronic dart board 11 mounted in an upright cabinet 12. The electronic dart board 11 serves as a target for darts 13 which are adapted to be thrown at the board. The darts are preferably of the "safe" type in that they are virtually incapable of penetrating skin and unlikely to cause damage by accidentally hitting objects other than the dart board. The dart board 11 is divided into a plurality of separate target sections or plates 14 denoting different target areas. Each target plate contains a large number of closely spaced holes for securing a dart in the section by its tip after being thrown at and striking the target section.

The target plates 14 are slidably mounted in a spider framework 15 of radially extending ribs and concentric circular ribs thereby preventing lateral movement of the target section. Each rib is of substantially triangular cross-section so that if struck by a dart, the dart deflects off to one of the target sections and into a hole instead of merely bouncing off the rib. To insure proper sliding movement in the spider framework 15, target sections 14 typically have guides attached to their outside edges in the form of ridges. Each of the target sections has a switch device located behind such that the impact force of a thrown dart hitting a target section displaces the target section back to a position which closes the switch momentarily signaling a target section hit; the target section then returns to its normal open position at the face of the board. The switches associated with the target sections are kept in their normally open positions by biasing the target sections to the face of the board using a resilient biasing material such as a solid rubber sheet. A switch matrix of imprinted Mylar sheets are preferably used, providing switching of the desired duration and continuity during the momentum transfer from a dart.

On the control panel 16 of the dart game are several push button switches 17 for selecting between different dart games and various game options such as the number of players. A next player button is provided to signal, when necessary, to the game that a particular player's turn is over. In the event that a player throws a dart and misses the dart board completely, the game will be unable to detect this miss until the player presses the next player button indicating that he has thrown 3 darts and his turn is over. A pair of coin slots 18 are located in the base of the machine for operating this coin-operated version of the game.

Display means 19 is located alongside the control panel 16 for displaying various information about the operation and conditions of the game. In the initial stage of a game the display means 19 indicates the number of coins dropped into the machine and the corresponding game options available. The number of players in the game is determined by the number of coins received through the coin slots 18. The display means 19 guides a player through the selection of a game and the number of players in the game. As a function of its display capabilities, the display means 19 described herein allows for more than one display device such as a video display screen, liquid crystal display, electronic display or the like. As will be apparent from the following description, display means of the present invention includes the video display screen and/or liquid crystal display. Typically, one of the control panel push buttons will act as a sequencer through the various games available, while another push button is used to select the current game in the sequence. During the selection process the display means provides a player with the options and choices available to him for selection. A series of audible tones are generated by a speaker 20 to guide a player through the selection process. For example, a bell may be used to assist the player by acknowledging that his choice has been registered; a buzzer may inform him that he is attempting to make an invalid selection.

Figure 2:
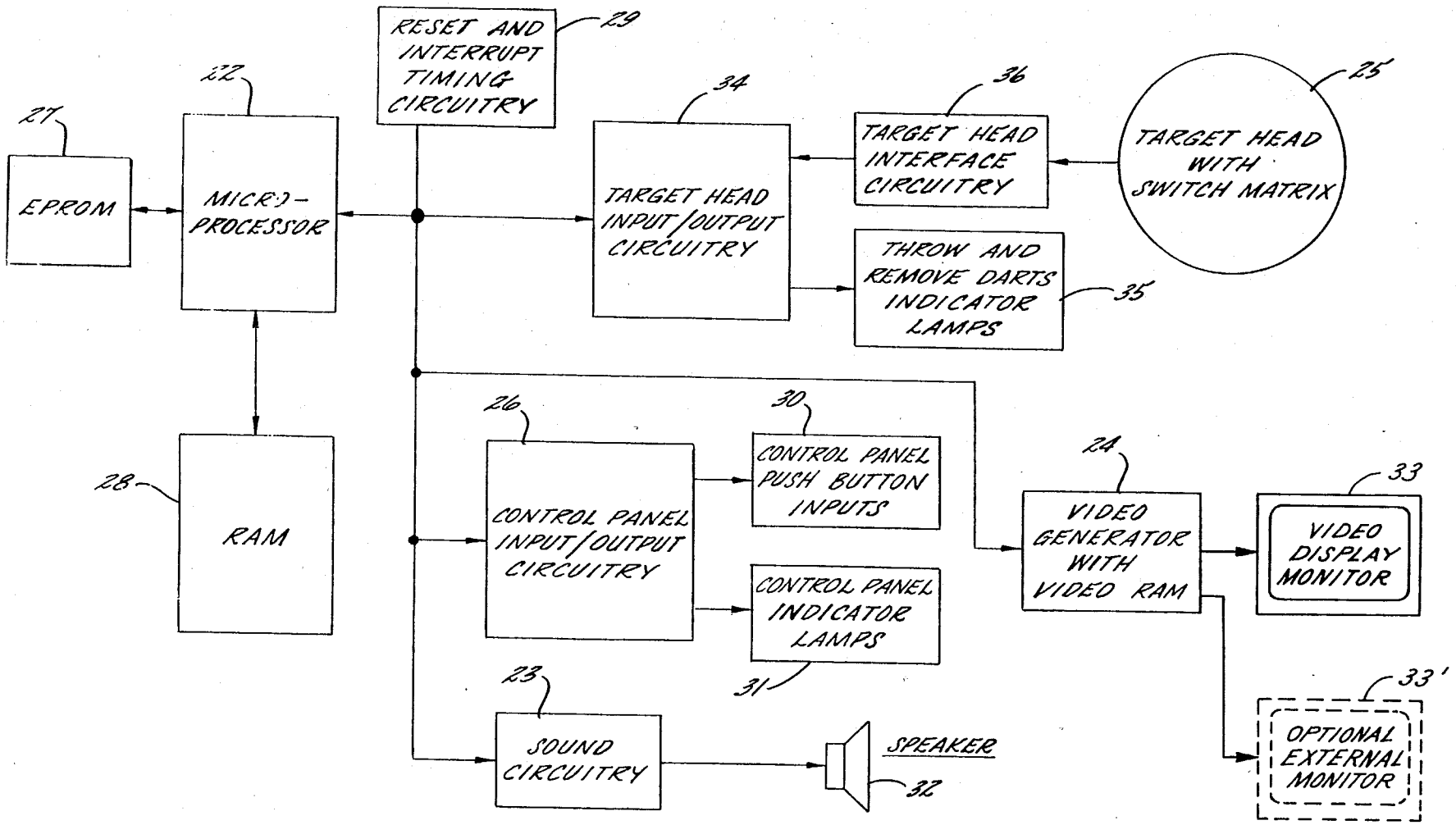
FIG. 2 is a block diagram showing the relationship between the internal components of the game.
Figure 2A:
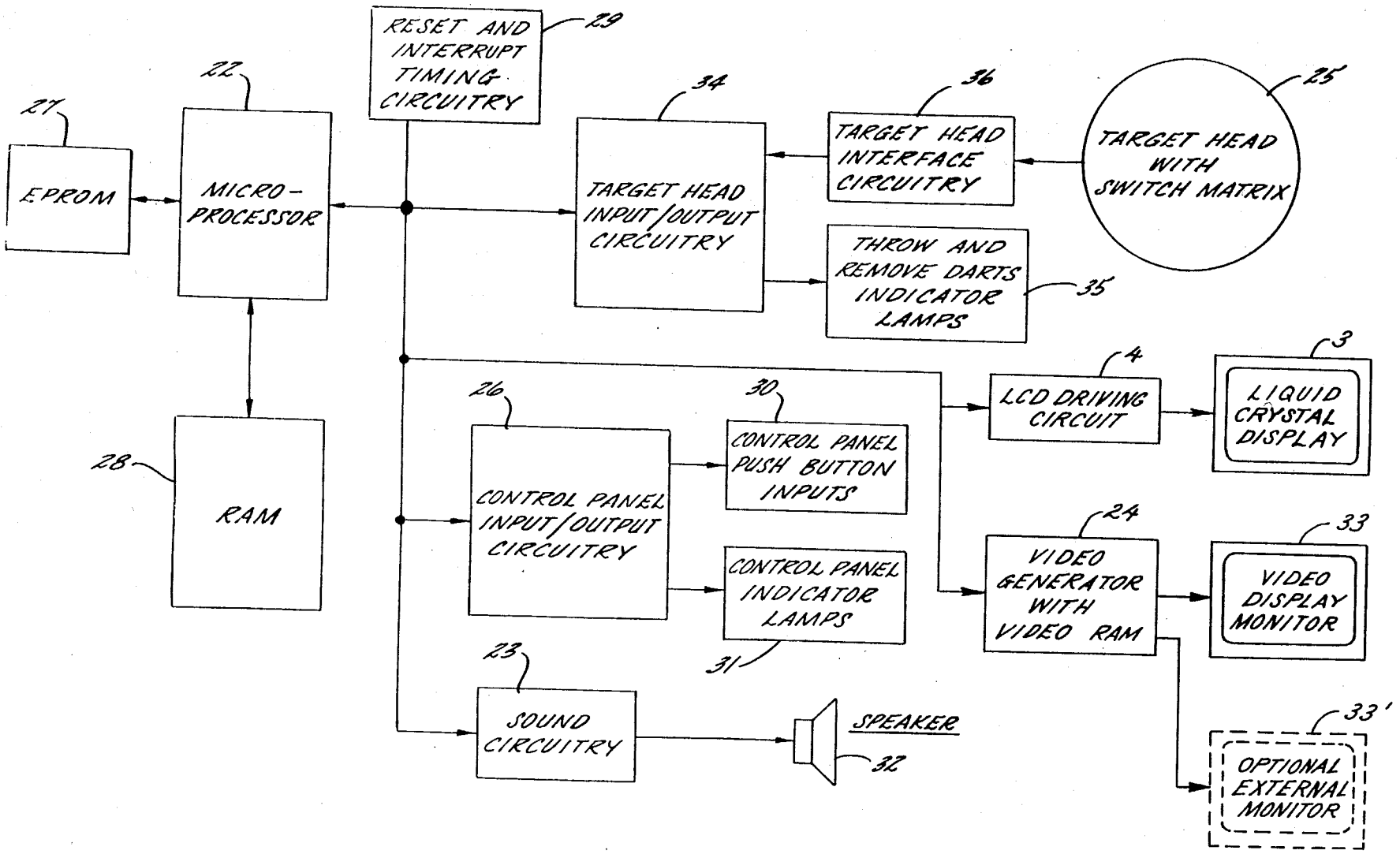
FIG. 2*a* is a block diagram showing the relationship between the internal components of the game in an alterative embodiment.

Turning to FIG. 2, a block diagram of the internal components of the invention is shown. The microprocessor 22 is at the heart of the operation by providing signals for operating sound 23, video generation circuitry 24; reading signals from the target head 34 and control panel input/output circuitry 26; and running instructions encoded in the erasable programmable read-only memory (EPROM) 27 for proper game operation. In a block diagram of the internal components of an alternative embodiment, depicted in FIG. 2*a*, the LCD driving circuit 4 drives the liquid crystal display 3 in response to signals received from the microprocessor 22. The microprocessor uses the random access memory (RAM) 28 as a working area to calculate and store temporary values. Preferably RAM 28 is supplied with an internal battery backup (not shown), and a small portion of the memory may be used by the microprocessor 22 to store high scores, game popularity data or similar values which are desired to be retained when the power is turned off. The EPROM 27 contains all the microprocessor instructions (i.e., algorithms) necessary for proper operation of the games according to their rules. This includes instructions for initialization, game and player selection processes, and all the instructions necessary to play each of the available games.

According to one important aspect of the invention, the EPROM 27 is contained within a single unit such as a cartridge which may easily be removed and interchanged, thus allowing a different set of instructions to be used for operation. This feature provides a convenient means for changing the rules of particular games, perhaps for a certain geographical region where such rules are more common or preferred. Whenever such a change is made, all the other components and connections remain the same except for the EPROM 27 and panel 16 which may list the games available. This feature also allows games to be changed periodically to produce variety and may also be used to keep the more popular games or rules available.

Synchronization of the various operations of the system is done via the reset and interrupt timing circuitry 29 which alerts the system to interrupt and reset conditions, such as may occur when coins are dropped into the machine or certain control panel signals are received. The push button input 30 signals from the control panel are linked to the system via the control panel input/output circuitry 26. Indicator lamps 31 on the control panel are also driven by this control panel input/output circuitry 26. The microprocessor 22 sends appropriate signals to the sound circuitry 23 to drive a speaker 32 for generating a variety of different sound effects. The microprocessor 22 also sends appropriate signals to the video generator with video RAM 24 to drive the video display monitor 33; and/or to the LCD driving circuit 4 to drive the liquid crystal display 3 according to different events and conditions of the game. Signals from the target head with switch matrix 25 are received by the target head interface circuitry 36 for conversion to a form which may readily be read and recognized by the target head input/output circuitry 34. The throw and remove darts indicator lamps 35 are driven by the target head input/output circuitry 34, which receives target head indicator lamp control signals from the microprocessor 22.

Figure 3:
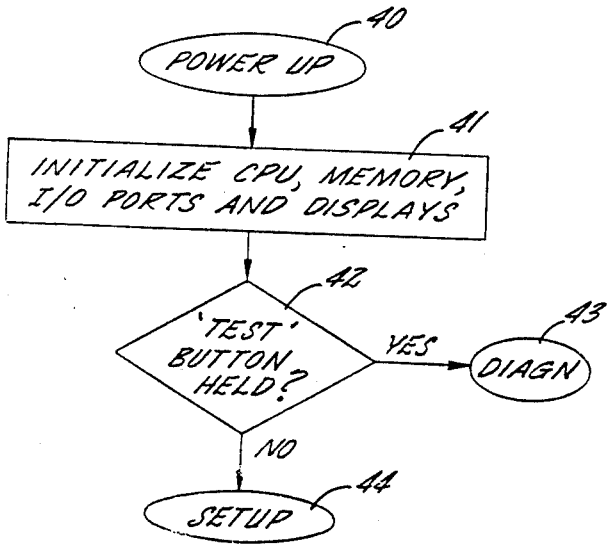
FIG. 3 is a flowchart of the POWER UP sequence of the game.

Turning now to FIG. 3, a flow diagram of the power up procedure of the invention is shown. Upon power up (step 40), an initialization routine (step 41) begins which includes initializing various parts of the CPU such as the program counter, stack pointer and internal registers. The RAM memory is then initialized along with the various I/O ports and displays. Next, in step 42, if a TEST button (usually located behind the coin slot door) is depressed then a diagnostic routine will be run in step 43, otherwise game set up procedures will begin from step 44.

Figure 4:
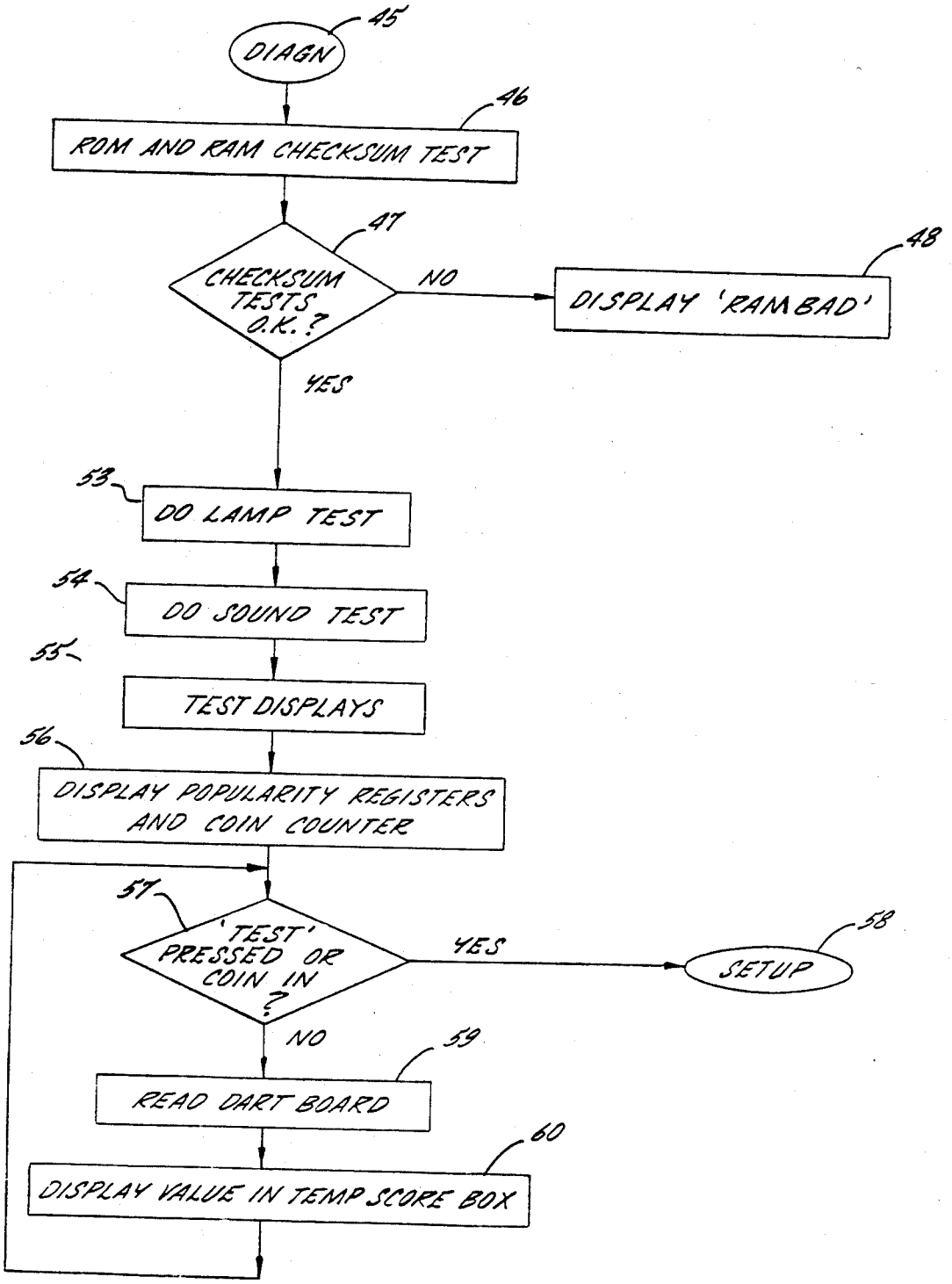
FIG. 4 is a flowchart of the diagnostics routine.

A flow diagram of the diagnostic routine is given in FIG. 4; it tests and checks several elements of the invention to insure proper operation. The first step in the diagnostic routine is the EPROM and RAM checksum test in step 46. In step 47, if the results of the checksum tests show no indication of error, then execution continues to step 52; otherwise, a "RAM BAD" message is displayed in step 48. Upon completion of a good checksum test, the lamps on the game are tested individually in step 53, along with a test of the various sounds (step 54) and the displays (step 55). Next, in step 56, the game popularity registers and coin counter values are displayed as read from the RAM with internal battery backup. At this point in step 57, if the TEST button has been pressed or a coin has been received then the SETUP procedure is initiated from step 58. Otherwise, further diagnostic testing is done consisting of the dart board switch matrix being read (step 59) and displayed (step 60). This additional diagnostic procedure then loops back to step 57 and repeats until the TEST button has been pressed or a coin has been received which begins the SETUP procedure in step 58.

Figure 5:
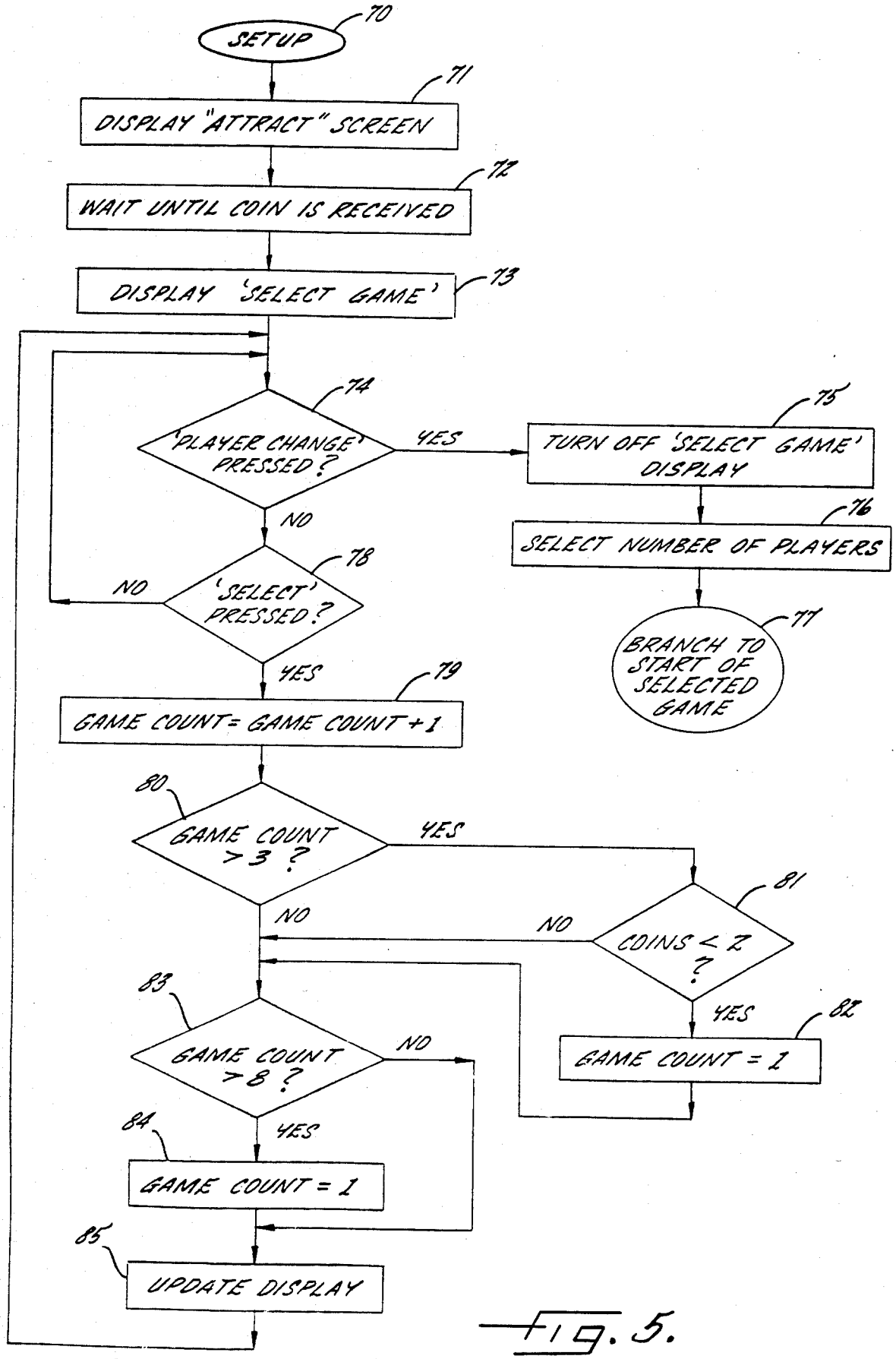
FIG. 5 is a flowchart of the SET UP procedures.

The game SETUP procedure as shown in FIG. 5 counts the money received, selects the particular game to be played and selects the number of players in the game. In the present embodiment of the invention there are eight different games and two cost categories—the one-coin games and the two-coin games. Games 1 through 3 are designated as one-coin games and games 4 through 8 are designated as two-coin games. Until a coin is received by the game, an 'ATTRACT' display screen is displayed (step 71) to draw attention and attract players to the game. Upon receiving a coin in step 72, a SELECT GAME display is shown in step 73 to provide information and the utility for selecting a particular game of the many which are available. As is apparent from FIG. 2*a*, information for display may be routed to the video display or the LCD display, or preferably both displays. During the game selection procedure, one of the games is designated as the 'current' game. This is done by distinguishing one game from the others by boxing the name, or using flashing or highlighting display attributes. The player has the option of selecting the 'current' game or changing the 'current' game to the next available game in the sequence. In step 74, if the PLAYER CHANGE button is pressed, the 'current' game is selected, then the displays are updated in step 75, the number of players for the game are determined from the number of coins received in step 76 and execution branches to the start of the selected game from step 77. If in step 78 the SELECT button was pressed instead of the PLAYER CHANGE button then the game count is incremented as in step 79. Step 80 checks which cost category the 'current' game is in. If the game count is greater than 3, then it is a two-coin game and step 81 is done, otherwise it is a one-coin game and step 83 is done. In step 81, if the game has received less than two coins, then the game count is set back to 1 in step 82, so a two-coin game cannot be selected. In step 83 the game count is checked to see if it is greater than the maximum number of 8. If the game count is greater than 8 then it is set back to 1 in step 84, otherwise step 84 is bypassed. Next, in step 85, the displays are updated to reflect the new selection information, then the procedure loops back to step 74 for another selection iteration. This looping continues until a game selection is made in step 74, which in turn results in the start of the selected game in step 77.

As an example, one of the games which may be played is the game of cricket. Cricket is a dart game with a more complex set of rules for determining game conditions and scoring. The game is usually played by two players and only uses segments 15–20 and the bullseye. At any time, a segment is either "open" or "closed" for a particular player. At the beginning of the game all segments are "open"; a segment becomes "closed" by a player by scoring 3 hits in the segment. The hits can be 1 triple hit, 1 single and 1 double, or 3 single hits. A player scores points in a segment which he has closed yet still remains open for the other player. The player scoring 3 hits in all segments 15–20 and the bullseye, and scoring the highest number of points wins. The display features of the present invention provide means for indicating to the players the open and closed segments and the current score, allowing the cricket game to be self-scoring rather than scored by hand—the only method available previously. FIGS. 6–9 show the logic flow of a cricket game as realized in the preferred embodiment of the invention.

Execution of the cricket game begins in step 91 with initialization and continues to step 92 which runs a game startup routine. Next, in step 94, the number of darts thrown at and registered by the board are checked. If there were 3 darts thrown then the player's turn is over and the procedure goes to step 95. Otherwise, in step 104, the game waits until either a dart is thrown or the PLAYER CHANGE button is pressed. In step 105, if the PLAYER CHANGE button was pressed, then the player has thrown 3 darts as indicated in step 106, and execution goes back to step 93. Otherwise, a dart was thrown and registered by the dart board and the segment number that was hit along with its value is recorded in step 108. Next, in step 109, if the segment number was not in the range 15–20 or a bullseye, then the hit does not affect the score and the game gets prepared for the next dart by branching to the NXDART routine from step 110. If the hit was within the range 15–20 or a bullseye, then the segment is checked to see if it was closed by both players in step 111; if it was, then NXDART is done from step 112, otherwise the procedure goes to step 113. In step 113, if the segment has been closed by the opposing player and is still open for the current player then the score will not be affected, but the hit counter for the segment hit must be updated and a check must be done to see if the segment should now be closed. Step 115 updates the hit counter for the segment and step 116 checks to see if the necessary 3 hits required to close the segment have been made. If 3 hits have been made on the segment, then it is closed in step 117. The NXDART routine is then started from step 118. If in step 113 the opposing player segment closed and the current player open condition is not true then the procedure branches from step 114 to step 120 in FIG. 7. In step 121, if the segment is not open for both players, then it can be deduced from the previous logic flow that the segment was closed by the current player and is still open for the opposing player. Under this condition, the current player adds points to his score by branching to the ADDSCR routine from step 122. If in step 121 the segment was open for both players, then the segment hit counter for the current player is updated in step 123, and in step 124 the segment is checked to see if it has the necessary number of hits to be closed. If the segment does not have more than 2 hits then the NXDART routine is evoked from step 125, otherwise the segment is closed in step 126. If the current player hit a segment which gave him more that the required number of hits to close the segment (i.e. a double or triple segment), then the extra hits are calculated in step 127 and the score is updated accordingly by branching to ADDSCR from step 128.

Figure 8:
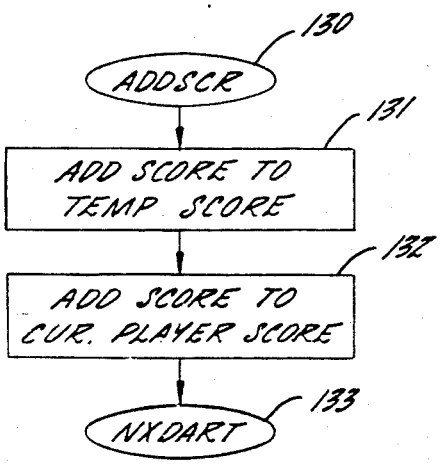
Figure 9:
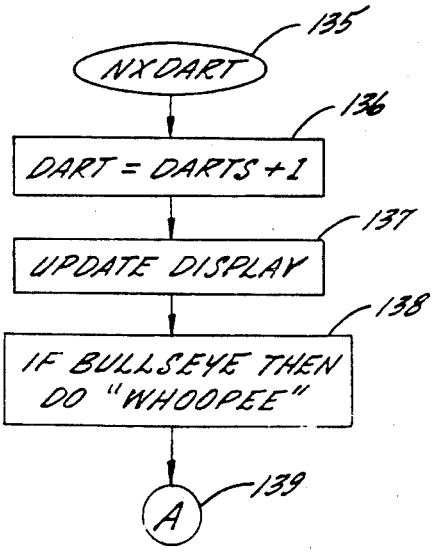

The ADDSCR routine in FIG. 8 does the necessary updating of the current player score. The temporary score is the score the current player has achieved so far during his turn in the round. This value is updated in step 131, then the current player total score is updated in step 132. The procedure then branches to the NXDART routine from step 133. FIG. 9 shows the NXDART routine which prepares the game for the next dart to be thrown. The dart count is incremented in step 136 and the displays are updated in step 137. If a bullseye was hit, then a "WHOOPEE" sound is done in step 138. The procedure then loops from step 139 of FIG. 9 to step 93 of FIG. 6 to continue the game. The looping continues until a winner is determined.

Figure 6:
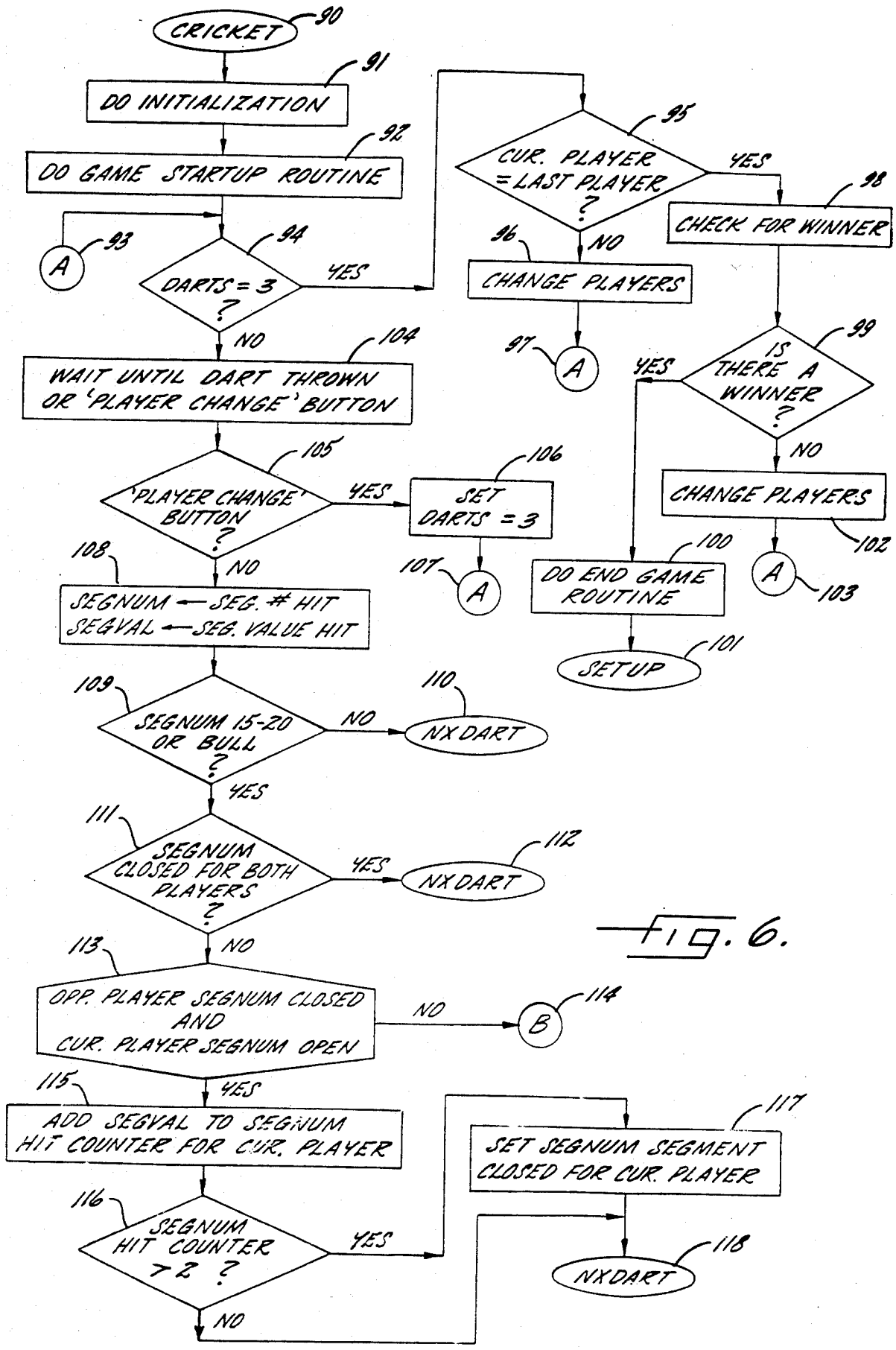
FIGS. 6–9 are flowcharts depicting the logic flow of a cricket game of darts.
Figure 7:
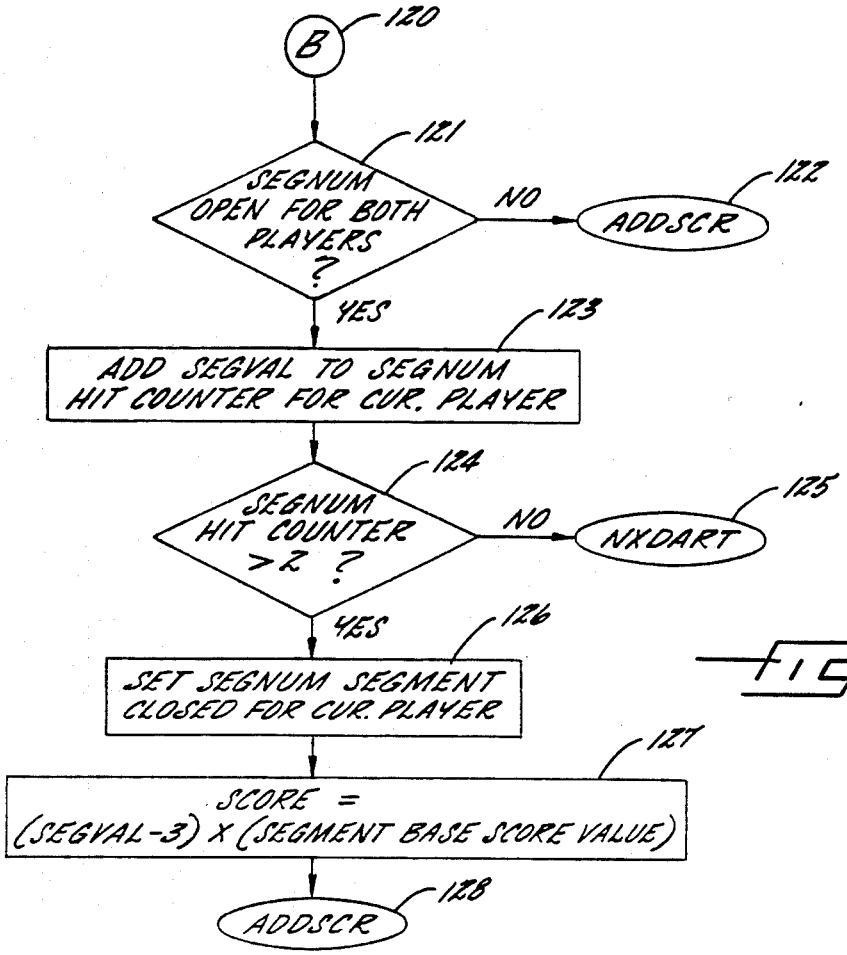

In step 94 of FIG. 6, if the player has thrown 3 darts then his turn is over and the procedure continues to step 95. If the current player was the last player in the group then a check for a winner is done in step 98, otherwise a routine to change players is done in step 96 and the procedure loops back to step 93 from step 97. In step 99, if a winner has been determined then an end game routine is done in step 100 followed by the SETUP procedure for a new game. If there is no winner yet in step 99, then a routine to change players is done in step 102 and the procedure loops back to step 93 from step 103.

From the foregoing, it can be seen that the self-scoring electronic target game of the present invention may be used for playing dart games with many intricate and complex rules. The invention is equipped with one or more displays for selecting a game and displaying information during the play of the game such as score and various game conditions. Furthermore, different games can be chosen and new ones introduced by virtue of having a removable cartridge—a static electronic memory unit—which may conveniently be removed and interchanged from the game. Although the invention has been described in detail with respect to a preferred embodiment, it is not so limited as changes and modifications may be made therein which still remain within the full intended scope as defined by the appended claims.

What is claimed is:

1. An electriconic dart game apparatus to be played by one or more players having successive turns which comprises an entire game, said apparatus comprising in combination:

an electronic dart board forming a target for a dart, said dart board comprising a plurality of radially extending ribs and concentric circular ribs dividing the dart board into a plurality of scoring segments each containing a large number of closely spaced holes corresponding substantially to the cross-sectional dimensional of the tip of said dart, one or more of said scoring segments comprising a scoring element, and a switch matrix means for electrically indicating one of the plurality of scoring segments hit by a thrown dart;

a first electronic memory storage area containing algorithms for scoring one or more different dart games wherein the value of points earned in a particular turn of said one or ore different dart games is dependent upon the scoring segments hit during previous player turns;

a second electronic memory storage area for retaining information regarding which of one or more of said scoring elements were hit by a thrown dart during at least one previous turn of the same player;

selection means for selecting said algorithms for a particular one of said one or more different dart games;

an electronic data process means responsive to said electronic dart board, said first and second memory storage areas and said selection means for (1) detecting and distinguishing said electrical indication of a target scoring segment hit by said thrown dart, (2) calculating from said algorithms selected by said selection means appropriate dart game conditions for each of said plàyers, including the score and (3) providing said conditions and an indications of said information for display; and a means for displaying said conditions and an indication of said information.

2. An electronic dart game as claimed in claim 1 wherein said electronic dart board, said first electronic memory storage area and said electronic data processor are all housed together with said display means disposed within the viewing region of said electronic dart game.

3. An electronic dart game apparatus as claimed in claim 1 wherein said first electronic memory storage area is contained within a single removable cartridge for replacement or interchange with another cartridge containing said first electronic memory storage area having different algorithms for different dart games.

4. An electronic dart game apparatus as claimed in claim 1 wherein said means for displaying said conditions and an indication of said information includes a video display screen.

5. An electronic dart game apparatus as claimed in claim 1 wherein said means for displaying said conditions and an indication of said information includes a liquid crystal display.

6. An electronic dart games apparatus as claimed in claim 1 wherein said information includes an indication of the number of times a scoring segment is hit during a game.

7. An electronic dart game apparatus as claimed in claim 1 wherein said information includes an indication of the availability of certain ones of said scoring segments for game play.

8. An electronic dart game apparatus for automatically scoring a dart game requiring consideration of events occurring during previous player turns, said apparatus comprising in combinations:

a dart board forming a target for darts thrown by players of said dart game, said dart board comprising a plurality of scoring segments, and a sensing means for detecting when one of said scoring segments is hit by a thrown dart;

a first memory storage area containing algorithms for said dart game wherein the value of points earned in a particular turn of said dart game is dependent upon the scoring segments hit during previous player turns;

a second memory storage area for retaining information regarding said scoring elements hit by a thrown dart during at least one previous turn of the same player; and a processor means responsive to (1) the detection by said sensing means of a scoring segment hit by a thrown data and (2) said information in said second memory storage area for providing data for said algorithms and executing said algorithms to determine a score.

9. An electronic dart game apparatus as claimed in claim 8 including a display responsive to said processor means for visualizing said score.

10. An electronic dart game apparatus as claimed in claim 8 wherein said dart board comprises a plurality of radially extending ribs and concentric circular ribs dividing the dart board into said plurality of scoring segments, each of said scoring segments containing a large number of closely spaced holes corresponding substantially to the cross-sectional dimension of the tip of said dart.

11. An electronic dart game apparatus as claimed in claim 8 wherein said information includes the number of times each of said scoring segments has been hit by a thrown dart over a plurality of turns of one player.

12. An apparatus for a dart game to be played by one or more players having successive turns which comprises an entire game, said apparatus employing a dart having a slender tip, said apparatus comprising in combination:

a dart board forming a target for said dart, said dart board comprising a plurality of scoring segments, and a switch matrix means for detecting which one of the plurality of scoring segments is hit by a thrown dart;

a memory storage area containing rules and instructions for said dart game and a record of the number of times each one of said plurality of scoring segments has been hit by a thrown dart;

a first means responsive to said switch matrix means and said memory storage area for (1) determining the number of points to be added to a score in response to said thrown dart hitting said one of said plurality of scoring segments and (2) providing information for visual display regarding the number of times said one of said plurality of scoring segments has been hit during said entire game; and a display responsive to said first means for visualizing said information.

13. An electronic dart game apparatus as claimed in claim 12 wherein said display is a video monitor.

14. An electronic dart game apparatus as claimed in claim 12 wherein said dart game comprises a plurality of radially extending ribs and concentric circular ribs dividing the dart board into said plurality of scoring segments, each of said scoring segments containing a large number of closely spaced holes corresponding substantially to the cross-sectional dimension of the tip of said dart.

15. An electronic dart game apparatus as claimed in claim 12 wherein said display is responsive to said first means for also visualizing the score of said dart game.

* * * * *

UNITED STATES PATENT AND TRADEMARK OFFICE

CERTIFICATE OF CORRECTION

PATENT NO. : 4,793,618

DATED : December 27, 1988

INVENTOR(S) : Tillery, Michael L.; and Beall, Paul F.

It is certified that error appears in the above-identified patent and that said Letters Patent is hereby corrected as shown below:

At col. 2, line 19, please delete the word "alterative"

and insert the word -- alternative --;

At col. 7, line 33, please delete the word "electriconic"

and insert the word -- electronic --;

At col. 7, line 51, please delete the word "ore"

and insert the word -- more --;

At col. 8, line 2, please delete the word "indications"

and insert the word -- indication --;

At col. 8, line 26, please delete the word "games"

and insert the word -- game --;

UNITED STATES PATENT AND TRADEMARK OFFICE

CERTIFICATE OF CORRECTION

PATENT NO. : 4,793,618

DATED : December 27, 1988

INVENTOR(S) : Tillery, Michael L.; and Beall, Paul F.

It is certified that error appears in the above-identified patent and that said Letters Patent is hereby corrected as shown below:

At col. 8, line 54, please delete the word "data"
and insert the word -- dart --.

Signed and Sealed this

Second Day of May, 1989

*Attest:*

DONALD J. QUIGG

*Attesting Officer*

*Commissioner of Patents and Trademarks*